United States Patent [19]

Morrow, Sr. et al.

[11] 4,194,638

[45] Mar. 25, 1980

[54] RING SUPPORTED TOWER CRANE

[75] Inventors: James G. Morrow, Sr.; Michael C. Anderson, both of Manitowoc; Richard L. Siehr, Two Rivers, all of Wis.

[73] Assignee: The Manitowoc Company, Inc., Manitowoc, Wis.

[21] Appl. No.: 913,502

[22] Filed: Jun. 7, 1978

[51] Int. Cl.[2] ..... B66C 23/26

[52] U.S. Cl. ..... 212/46 R; 212/58 R

[58] Field of Search ..... 212/46, 48, 49, 58 R, 212/59 R, 28; 414/695; 254/150 FH; 180/9.2 R

[56] References Cited

U.S. PATENT DOCUMENTS

| | | | |
|---|---|---|---|
| 3,777,900 | 12/1973 | Brewer | 212/58 R |
| 3,794,184 | 2/1974 | Higgins | 212/46 A |
| 3,977,530 | 8/1976 | Helm et al. | 212/46 R |
| 4,050,586 | 9/1977 | Morrow, Sr. et al. | 212/46 R X |
| 4,053,060 | 10/1977 | Wilson | 212/48 |
| 4,076,128 | 2/1978 | Tax | 212/58 R X |
| 4,081,081 | 3/1978 | Morrow, Sr. et al. | 212/59 R X |

FOREIGN PATENT DOCUMENTS

| | | | |
|---|---|---|---|
| 1481298 | 5/1967 | France | 212/46 R |

*Primary Examiner*—Stephen G. Kunin
*Assistant Examiner*—Terrance L. Siemens
*Attorney, Agent, or Firm*—Leydig, Voit, Osann, Mayer & Holt, Ltd.

[57] ABSTRACT

A tower crane is carried on a platform rotatably mounted on a large ring with the tower pivotally mounted on the forward portion of the platform above the ring and a mast mounted on the platform adjacent the boom and extending upwardly and rearwardly therefrom. A counterweight support at the rear end of the platform also rides on the ring and is connected to the top of the mast by a backstay. At the top of the tower is a pivotally mounted, forwardly projecting boom and an upwardly and rearwardly inclined boom strut whose upper end is pin-connected to the top of the mast by a backstay strut. A tower backstay is connected to an upper part of the tower and extends generally horizontally rearwardly to the top of the mast where it is also pin-connected. By removing the pin-connections at the top of the mast, the tower, boom, boom strut, backstay strut and tower backstay can be pivotally raised and lowered as a unit by powered erection rigging mounted on the platform. A pendant is connected between an intermediate point on the tower backstay and a lower point on the tower to insure that the openings for the pin-connections at the top of the mast are properly aligned when the tower is erected. Additional hoist mechanisms and rigging are carried on the platform for adjusting the boom angle and for raising and lowering a load. In the preferred embodiment, the crane includes two laterally spaced towers, booms, masts, backstays and struts interconnected as described above.

8 Claims, 5 Drawing Figures

RING SUPPORTED TOWER CRANE

The present invention relates generally to high capacity lift cranes and more particularly concerns a self-erecting tower crane rotatably mounted on a large ring.

Modern lift crane design is faced with a number of conflicting requirements. In the first place, high capacities are demanded, involving combinations of booms and/or towers hundreds of feet long and loads ranging up to 1200 tons or more. Such high capacities are best handled by fixed or semi-portable configurations like the large ring concept disclosed and claimed in U.S. Pat. Nos. 3,485,383 and 4,042,115, both of which are owned by applicants' assignee. As indicated in those patents, most crane users also demand some degree of portability, which becomes increasingly difficult as crane designs are scaled up to handle greater loads. Also, the question of economy is always present and with larger, inherently more expensive devices, the need for additional equipment to assist in erection and disassembly and the tying up of the apparatus in a configuration which is not fully utilized becomes increasingly costly.

Accordingly, it is a primary aim of the present invention to provide a high capacity tower crane in which the tower, boom and associated backstays and struts may be self-erected as a unit with the hoist machinery on the crane platform.

Another object of the invention is to mount such a tower crane on a large diameter ring such that the tower can also be alternately used as a boom, if desired.

A further object of the invention is to provide a crane of the above character with twin towers, booms and associated backstays and struts wherein the individual components are themselves relatively inexpensive and which can also be assembled in a variety of configurations to satisfy a variety of applications and lift requirements.

It is also an object of the invention to provide a crane assembly made up of components that can be readily manipulated to create a high capacity crane that is semi-portable.

Figure 1:
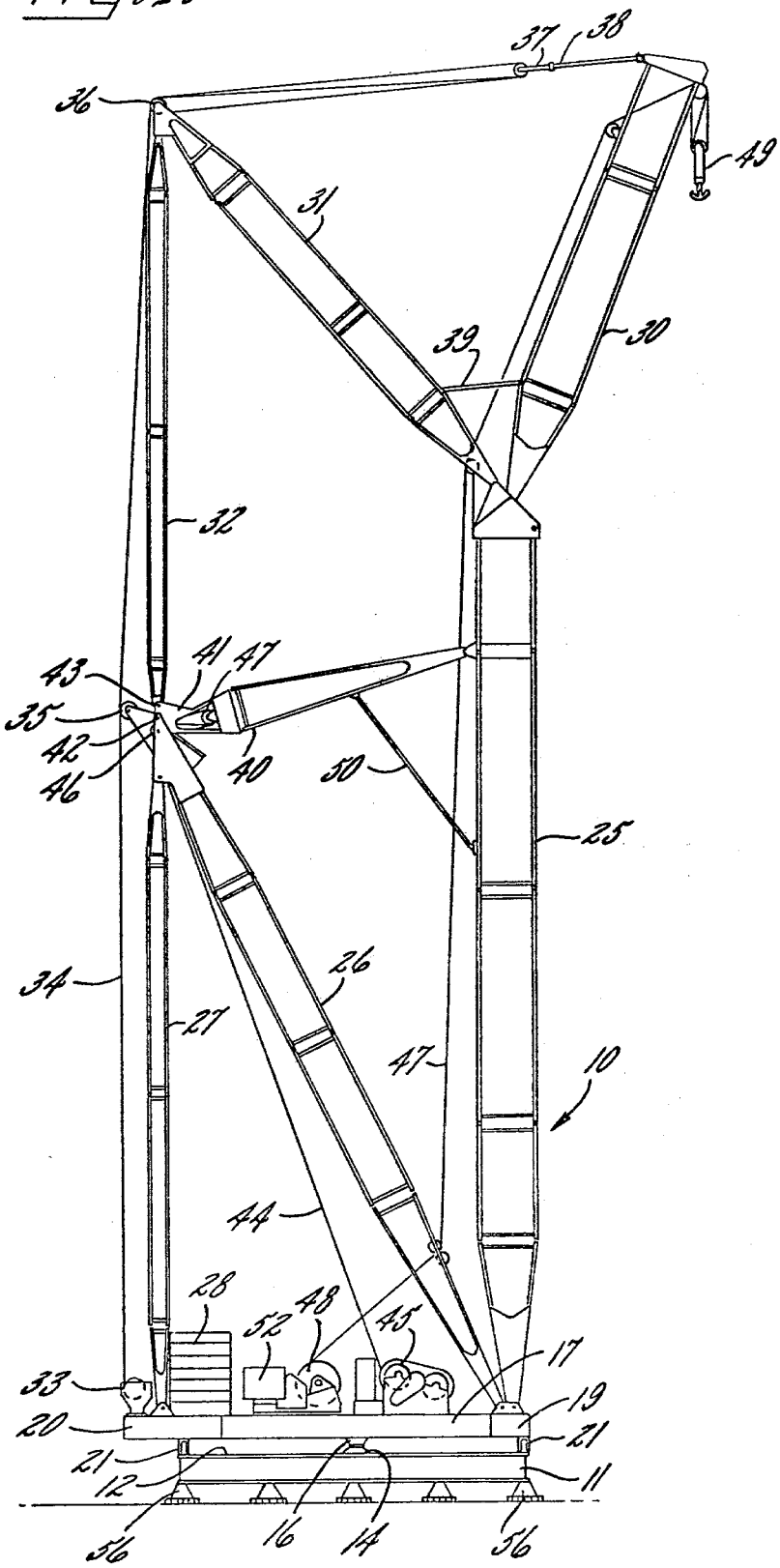
Figure 3:
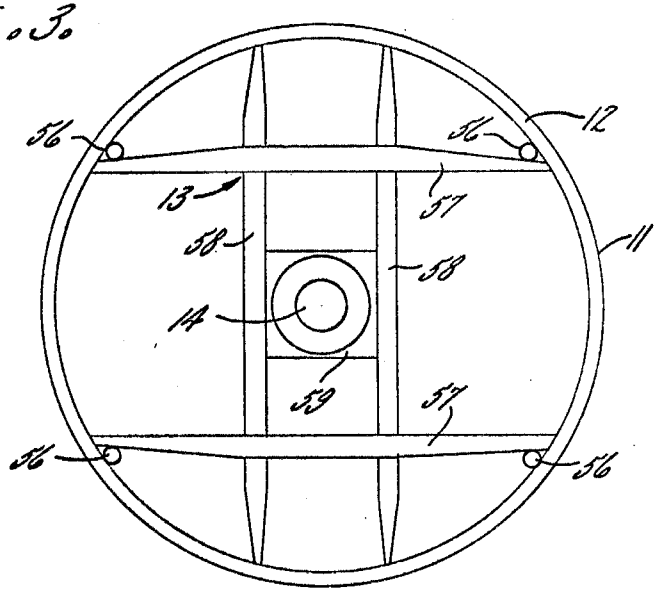
Figure 2:
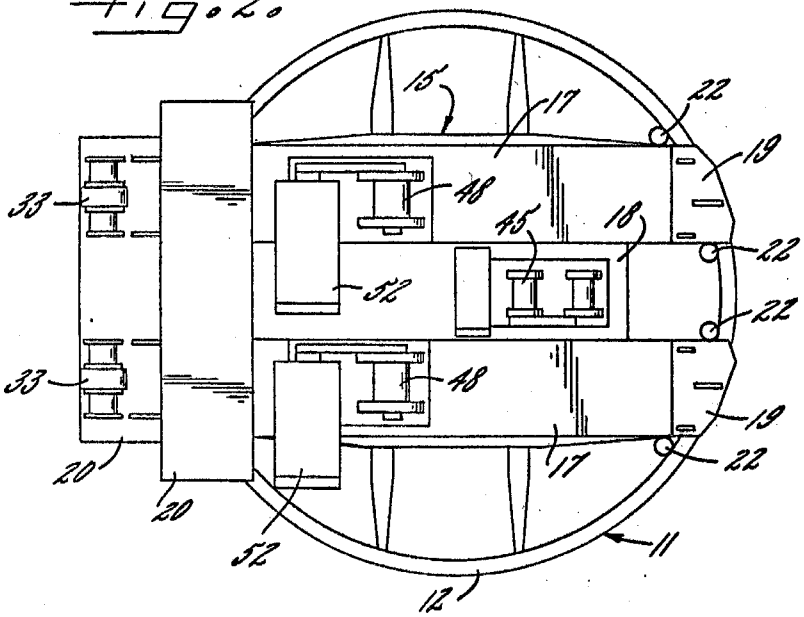
Figure 4:
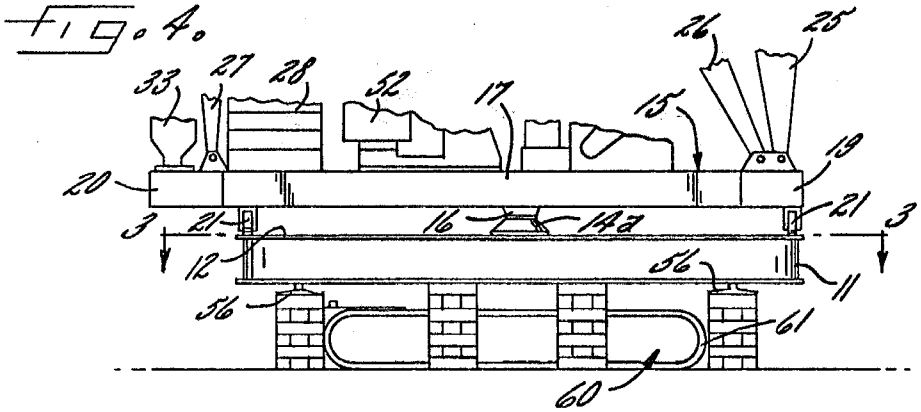
Figure 5:
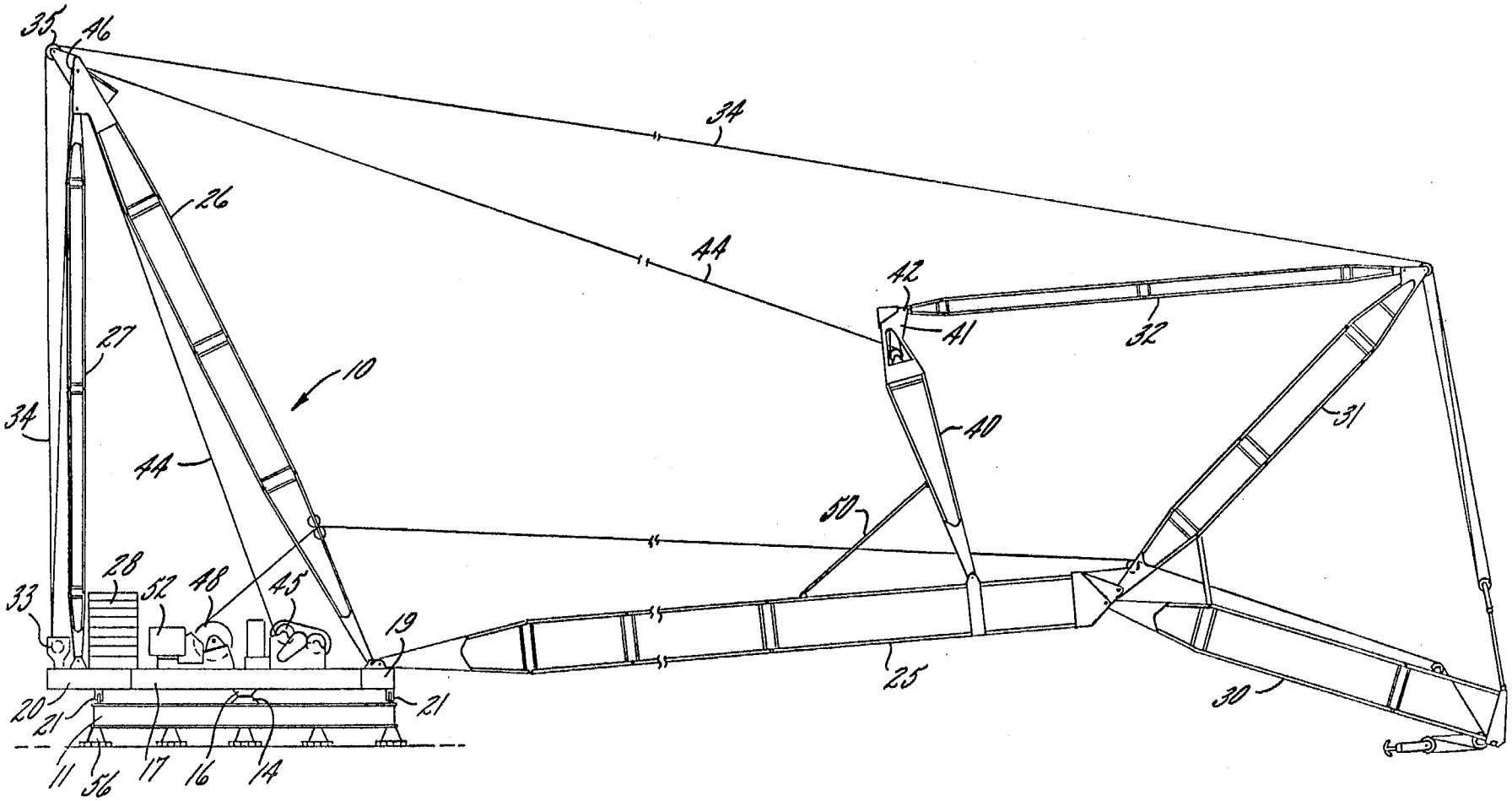

These and other objects and advantages of the invention will become apparent upon reading the following detailed description and upon reference to the drawings, in which:

FIG. 1 is a side elevation of the high capacity crane of the present invention;

FIG. 2 and 3 are sections, with some parts removed, substantially as seen along lines 2—2 and 3—3 in FIGS. 1 and 4, respectively;

FIG. 4 is a partial side elevation showing the crane of the invention mounted on a crawler-type transporter; and, FIG. 5 is a side elevation, similar to FIG. 1, with the tower and boom in the initial stages of being erected.

While the invention will be described in connection with certain preferred embodiments, it will be understood that we do not intend to limit the invention to those precise embodiments. On the contrary, we intend to cover all alternatives, modifications and equivalents as may be included within the spirit and scope of the invention as defined in the appended claims.

Turning first to FIGS. 1-3, there is shown a crane 10 embodying the invention and including a ring 11 defining an annular track 12, structure 13 within the ring 11 supporting and including a central king pin 14, and an elongated platform 15 having a central bearing member 16 fitted for rotation on the king pin 14. In the illustrated embodiment, the platform 15 includes two large box-like side weldments 17 interconnected by a smaller center weldment 18. Each of the side weldments 17 has a carrier 19 connected at its front end with the carrier 19 in riding contact with the track 12 and a counterweight support 20 connected at its rear end also in riding contact with the track 12. The carrier 19 and the support 20 mount wheels 21 which ride on the track.

For rotating the platform 15 on the king pin 14 and track 12, a plurality of swing drive motors 22 are provided. Preferably, the swing drive motors 22 are hydraulically activated and the drive gears are held in constant engagement with teeth formed on the inner periphery of the ring 11 in the manner taught by U.S. Pat. No. 4,013,174, also owned by applicants' assignee, and the disclosure of which is incorporated herein by reference. As shown in FIG. 2, four swing drive motors are provided, one on each side of each of the carriers 19 and it should be understood that two or four additional swing drive motors 22 may also be provided at the sides of the counterweight supports 20.

In the preferred embodiment, a tower 25 is pivotally mounted on each of the carriers 19 which also mounts an upwardly and rearwardly inclined mast 26. A mast backstay 27 interconnects the upper end of each of the masts 26 and the counterweight support 20 on which items of counterweight 28 are located. Pivotally mounted at the upper end of each of the towers 25 is a load handling boom 30. A boom strut 31 is also mounted on the top of each tower 25 and projects upwardly and rearwardly therefrom. The boom strut 31 is held in fixed position by a backstay strut 32 connected to the upper end of the boom strut and pin-connected to the top of the mast 26.

To raise and lower each of the booms 30, powered boom hoist mechanisms 33 are mounted on the counterweight support 20 and wire rope 34 wound on the hoist drums is reeved over sheaves 35 and 36 at the top of the mast 26 and boom strut 31. The wire rope 34 is normally rigged to make multiple reaches between the top of the boom strut and an equalizer assembly 37 secured to the free end of the boom 30 by fixed pendants 38. Preferrable the boom hoist mechanisms 33 are hydraulically driven as taught in copending U.S. application Ser. No. 747,331 filed Dec. 3, 1976, now U.S. Pat. No. 4,136,855, is also owned by applicants' assignee and the disclosure of which is incorporated herein by reference. It will be understood that as wire rope 34 is payed out from the hoists 33, the booms 30 are lowered and that reeving in the wire rope 34 raises the booms 30. To prevent the booms 30 from being raised over center of the towers 25, a boom stop 39 is interposed between the lower portions of the booms 30 and boom struts 31.

Pursuant to the invention, a tower backstay 40 is connected to each of the towers 25 and extends generally horizontally rearwardly to the top of the masts 26. The tower backstays 40 carries a mounting plate 41 with aperatures therein for receiving pins 42 and 43 which pass through similar aperatures located in the top of the mast 26 and the lower end of the backstay strut 32.

In accordance with one aspect of the invention, the towers 25, booms 30, boom struts 31, backstay struts 32 and tower backstays 40 may be erected and lowered as a unit. Thus, when the pins 43 are removed from the top of the mast 26, the components mentioned in the preceding sentence are all free to pivot as a unit about the pivotal mounting of the tower 25 on the carrier 19. For raising and lowering the tower 25, boom 30 and associated backstays and struts 31, 32 and 40, a wire rope 44 is wound on the drum of a hoist mechanism mounted 45 on the platform 15 and is reeved over a sheave 46 adjacent the top of the mast 26 and then to a block 47 carried by the rear end of the tower backstay 40.

Turning now to FIG. 5, the tower 25 and boom 30 of the crane 10 are shown in the initial stages of being erected. It will be understood that the tower 25 can be lowered further to rest on the ground or suitable blocking prior to assembly of the boom 30, boom strut 31, backstay strut 32 and tower backstay 40 as well as rigging the wire rope 34 for the boom hoist 33, wire rope 44 for the tower erection hoist 45 and a wire rope 47 which is wound on the main hoist mechanism 48 and carries the load handling hook block 49 at the end of the boom 30.

As the wire rope 44 is reeved in, the tower 25 is raised from its ground supported position to the position shown in FIG. 5. Continuing to reeve in wire rope 44, raises the tower higher and also begins to raise the boom 30 as well, provided that the boom hoist line 34 is taut. It will be understood that the boom 30 may be disposed at a greater angle with respect to the tower 25 than is shown in FIGS. 1 and 5, but that it can not be pulled back over center due to the boom stop 39.

In keeping with the invention, a pendant 50 is connected between an intermediate point on the tower backstay 40 and a lower point on the tower 25. During erection of the tower 25, the boom tip is preferrably lowered somewhat so that the weight of the boom 30 and hook block 49, acting through the boom hoist line 34, places the backstay strut 32 in tension. The slack is thus taken out of the pendant 50 and an accurately controlled position is established for the apertures in the mounting plate 41 to assure proper alignment with the corresponding apertures in the top of the mast 26 for insertion of the pins 43 when the tower is fully erected. It will also be understood that the pins 43 may be inserted and removed by suitable remotely controlled actuators such as hydraulic or pneumatic actuators, for example, (not shown).

As noted before, the preferred embodiment of the crane 10 has twin towers 25 pivotally mounted in laterally spaced relation on the forward carriers 19 of the platform weldments 17. Additionally, twin booms 30 are carried on the towers 25 and twin main hoist mechanisms 48 driven by engines 52 on the platform 15 are provided. Synchronization of the twin load lines 47 is desired or, in the alternative, an equilizer beam may be coupled to the load lines 47 with the hook block 49 carried at the center of the beam. It will also be appreciated, however, that many features of the mounting, rigging and erecting arrangements of the present invention are also advantageous for incorporation in a single tower crane.

As shown in FIGS. 1 and 5, the ring 11 is normally mounted on a plurality of pedestals 55 supported on the ground or other preposed surface. Preferrably, the ring 11 carries a plurality of hydraulic jacks 56 for use in installing the pedestals 55. Referring to FIG. 3, four jacks 56 are shown adjacent the ends of a pair of rigid side beams 57 which together with cross beams 58 and a central box section 59 make up the king pin support structure 13.

Alternatively, the ring 11 may be installed on the top of a self-propelled track-type transporter 60 such as shown in U.S. Pat. No. 4,069,884 also owned by applicants' assignee. It will also be understood, however, that due to the size and weight of the twin tower crane disclosed herein, each of the crawlers 61 of the transporter could be driven by its own engine (not shown) in order to provide for even greater mobility.

It will also be understood that when maximum lift capacity is not required the crane 10 can be assembled with the tower 25 used as a forwardly inclined lift boom. In that case, the boom 30, boom strut 31 and backstay strut 32 are not needed and can be left disassembled on the ground. Other rigging arrangements will also be apparent to those skilled in the art.

From the foregoing, it will be seen that the twin tower crane 10 of the present invention mounted on the ring 11 provides a heavy lift capability on the order of 1000 tons or more at heights in excess of 150 feet. The towers 25 and booms 30 together with their associated backstays and struts 31, 32 and 40 may also be erected as a unit. Additionally, the ring "may be mounted on a crawler transporter 60 to move the crane from place to place."

We claim as our invention:

1. A crane assembly comprising, in combination, a ring defining an annular track, platform means fitted for rotation on said track, said platform having tower carrier means at one end in riding contact with said track and a counterweight support means at the other end also in riding contact with said track, a tower pivotally mounted on said carrier means above said track, an upwardly and rearwardly inclined mast also mounted on said carrier, means interconnecting said counterweight support means and the top of said mast, a boom pivotally mounted on the top of said tower, an upwardly and rearwardly inclined boom strut also mounted on the top of said tower, means including a backstay strut releasably connected to the top of said mast and the top of said boom strut, a tower backstay releasably connected to the top of said mast and said tower and means including a powered hoist drum mounted on said platform and wire rope wound on said drum and reeved over a sheave adjacent the top of said mast for raising and lowering said tower, boom, boom strut, backstay strut and tower backstay as a unit when said backstay strut and tower backstay are unconnected from the top of said mast.

2. A crane assembly as defined in claim 1 wherein said releasable connections of said tower backstay and backstay strut to said mast include removable pins inserted through apertures formed in the top of said mast and in a mounting plate interconnecting said tower backstay and backstay strut.

3. A crane assembly as defined in claim 2 including a pendant connected between an intermediate point on said tower backstay and a lower point on said tower for assisting in maintaining said mounting plate apertures in proper alignment with said mast top apertures when said tower is erected.

4. A crane assembly as defined in claim 1 including a pair of laterally spaced towers, booms, boom struts, backstay struts and tower backstays which are raised and lowered as a unit.

5. A crane assembly as defined in claim 1 including boom stop means interconnecting said boom and boom strut for preventing said boom from being pivoted rearwardly over center of said tower.

6. A crane assembly as defined in claim 1 including means mounted within said ring defining a central king pin and means on said platform fitted for rotation on said king pin.

7. A crane assembly as defined in claim 6 wherein said mounting means includes a plurality of rigid beams interconnecting said ring and said king pin.

8. A crane assembly as defined in claim 6 wherein said mounting means includes a self propelled transporter unit for moving said crane from place to place.

* * * * *